US006372032B1

(12) United States Patent
Miki

(10) Patent No.: US 6,372,032 B1
(45) Date of Patent: Apr. 16, 2002

(54) FOUNDRY EXOTHERMIC ASSEMBLY

(76) Inventor: Masamitsu Miki, 1-25-15, Nakahara, Mitaka-shi, Tokyo (JP)

( * ) Notice: Subject to any disclaimer, the term of this patent is extended or adjusted under 35 U.S.C. 154(b) by 0 days.

(21) Appl. No.: 09/413,246

(22) Filed: Oct. 7, 1999

(30) Foreign Application Priority Data

Oct. 9, 1998 (JP) ..... 10-288498
Sep. 30, 1999 (JP) ..... 11-277690

(51) Int. Cl.[7] ..... C04B 35/14

(52) U.S. Cl. ..... 106/38.2; 501/106; 501/133; 501/153; 501/154; 164/527; 164/528; 164/529; 164/359; 523/218; 523/219

(58) Field of Search ..... 164/37, 40, 527, 164/528, 529, 359; 523/218, 219; 106/38.2; 501/106, 133, 153, 154

(56) References Cited

U.S. PATENT DOCUMENTS 4,248,974 A * 2/1981 Fujii et al. ..... 521/91
4,362,566 A * 12/1982 Hinterwaldner
4,574,869 A * 3/1986 Trinkl et al. ..... 164/360
4,665,966 A * 5/1987 Neu et al. ..... 164/359
5,632,326 A * 5/1997 Gough ..... 164/529
5,915,450 A * 6/1999 Aufderheide et al. ..... 164/359
5,983,984 A * 11/1999 Auderheide et al. ..... 164/527
6,133,340 A * 10/2000 Menon ..... 523/139
6,209,617 B1 * 4/2001 Vorndran et al. ..... 164/359
6,286,585 B1 * 9/2001 Twardoska et al. ..... 164/527

OTHER PUBLICATIONS

Hawley's Condensed Chemical Dictionary, Richard Lewis Sr 1993 Copyright—p. 917 for pigments definition.*

* cited by examiner

*Primary Examiner*—Paul Marcantoni
(74) *Attorney, Agent, or Firm*—Wenderoth, Lind & Ponack, L.L.P.

(57) ABSTRACT

A foundry exothermic assembly is formed by mixing hollow glass microspheres and an inorganic or organic binder with matrix forming constituents including an oxidizable metal, an oxidizing agent, a foundry refractory aggregate and, optionally, a pro-oxidant, and shaping and curing the mixture. The hollow glass microspheres are dispersed and embedded in the assembly matrix.

19 Claims, No Drawings

FOUNDRY EXOTHERMIC ASSEMBLY

BACKGROUND OF THE INVENTION

1. Field of the Invention

This invention relates to a foundry exothermic assembly, particularly to a foundry exothermic assembly formed by mixing an oxidizable metal, an oxidizing agent, an optional pro-oxidant, a foundry refractory aggregate and hollow glass microspheres, and shaping and curing the mixture. The assembly is characterized in that its matrix is composed of the oxidizable metal, the oxidizing agent, the optional pro-oxidant and the foundry refractory aggregate, and the hollow glass microspheres are dispersed and embedded in the matrix.

By "foundry exothermic assembly" is meant an exothermic riser sleeve, an exothermic core, an exothermic neck-down core, an exothermic mold, an exothermic pad, or a similar article.

Particularly typical of the foundry exothermic assembly according to the present invention is an exothermic riser sleeve for use in a mold. When the riser sleeve is attached to a mold and a molten metal is poured into the mold, the riser sleeve undergoes exothermic reaction. The heat produced by this reaction, together with the heat of the molten metal, melts and disperses the hollow glass microspheres dispersed and embedded in the riser sleeve matrix, whereby small pores form in the matrix to make it porous. As the heat-retaining effect of the riser sleeve relative to the molten metal is therefore markedly enhanced, the riser sleeve manifests excellent feeding effect.

2. Description of the Prior Art

Typical of conventional foundry exothermic assemblies is the exothermic riser sleeve obtained by shaping and curing, as main materials, a foundry refractory aggregate such as zircon sand, an exothermic material such as aluminum, and an oxidizing agent such as potassium nitrate. Since the apparent specific gravity of such a foundry exothermic assembly is around 1.2–1.5 g/cc, it cannot provide a very high level of heat retentivity with respect to the cast metal between the time of pouring the molten metal into the mold and the time the metal solidifies from the molten state.

SUMMARY OF THE INVENTION

An object of this invention is to provide a foundry exothermic assembly, more specifically a foundry exothermic assembly intended for attachment to a mold so that when molten metal is poured into the mold, the matrix of the assembly undergoes exothermic reaction and the heat produced by this reaction, together with the heat of the molten metal, melts and disperses the hollow glass microspheres embedded in the assembly matrix, thus causing small pores to form at the locations where the hollow glass microspheres were embedded and make the matrix porous, whereby the foundry exothermic assembly can manifest a very high level of heat retentivity with respect to the cast metal over the period from the molten state to the solidified state of the metal, good refractory property, and outstanding feeding effect.

To achieve this object, the present invention provides a foundry exothermic assembly which is formed by mixing hollow glass microspheres and an inorganic or organic binder with matrix forming constituents including an oxidizable metal, an oxidizing agent, a foundry refractory aggregate and, optionally, a pro-oxidant, and shaping and curing the mixture, the hollow glass microspheres being dispersed and embedded in the assembly matrix.

DETAILED DESCRIPTION OF THE PREFERRED EMBODIMENT

The foundry exothermic assembly according to the present invention is characterized in that it has hollow glass microspheres dispersed and embedded in its matrix.

The present invention does not particularly specify the type of material used to produce the hollow glass microspheres. They can, for example, be produced from an ordinary glass material like the soda-lime-silicate glass ($SiO_2$: about 72%, $Na_2O$: about 14–16%, CaO: about 5–9%) commonly used as a material for plate glass and glass for bottles, tableware and other containers. Any glass material suffices so long as its melting point is around 800° C. at the highest.

The amount of the hollow glass microspheres contained in the matrix is at least 10 wt %, preferably 20–40 wt %. The diameter of the hollow glass microspheres, while not particularly limited, should generally be 3.0 mm or less, preferably 1.2 mm or less.

The foundry exothermic assembly according to the present invention has hollow glass microspheres dispersed and embedded throughout its matrix. Take, for example, the exothermic riser sleeve that is typical of the foundry exothermic assembly according to the invention. When the exothermic riser sleeve is attached at the riser of a mold and molten metal is poured into the mold, the hollow glass microspheres dispersed and embedded in the matrix of the riser sleeve melt and disperse during the process of molten metal casting and solidification upon being heated to a temperature of, at the highest, around 800° C. by the heat of the molten metal and the heat generated by a combustion reaction that the heat of the molten metal triggers in the exothermic material (oxidizable metal and oxidizing agent) constituting the matrix of the riser sleeve. As a result, small pores form at the locations where the hollow glass microspheres were dispersed and embedded in the sleeve matrix. Since the matrix therefore becomes porous, the heat-retaining property of the matrix is markedly enhanced while its refractoriness remains unchanged. The riser sleeve can therefore produce an excellent feeding effect.

The mixture of materials for producing the foundry exothermic assembly according to the present invention is obtained by mixing hollow glass microspheres with an oxidizable metal, an oxidizing agent, a foundry refractory aggregate and, optionally, a pro-oxidant, and then adding an inorganic or organic binder and, optionally, a curing catalyst. The resulting mixture is shaped and cured to obtain the foundry exothermic assembly by a known sand mold molding method such as the $CO_2$ process, the self-harding process, the fluid sand mixture process, the hot box process or the cold box process.

The components of the material mixture according to the present invention that produce the exothermic reaction under heating by the molten metal poured into the mold are the oxidizable metal and the oxidizing agent, plus, optionally, if required, the pro-oxidant.

The oxidizable metal is typically powdered or granular aluminum, but magnesium and similar metals can also be used. Usable oxidizing agents include iron oxide, manganese dioxide, nitrate and potassium permanganate.

The foundry exothermic assembly according to the present invention can, as required, optionally contain a pro-oxidant such as cryolite ($Na_3AlF_6$), potassium aluminum tetrafluoride or potassium aluminum hexafluoride.

Usable foundry refractory aggregates include, but are not limited to, aluminum ash (slag occurring during melting of aluminum ingot, which consists chiefly of alumina but also contains some amount of metallic aluminum and the flux used during melting), silica, zircon, magnesium silicate, olivine, quartz and chromite.

The binder added to enable shaping of the material mixture for producing the foundry exothermic assembly according to the present invention can be any of various known types. Specifically, any type of binder can be used insofar as it enables the material mixture to be cured in the presence of a curing catalyst to a degree that ensures reliable maintenance of the shape of the particular one of the various kinds of foundry exothermic assemblies to be fabricated. Usable binders include, for example, phenolic resin, phenol-urethane resin, furan resin, alkaline phenol-resol resin, and epoxy alkaline resin.

To be effective, these binders should be added in an amount of at least around 5 wt % based on the weight of the foundry exothermic assembly.

In a preferred embodiment of the present invention, hollow glass microspheres are added to a mixture composed of powdered and/or granular aluminum, aluminum ash, iron oxide and cryolite, whereafter phenol-urethane resin is used as binder to shape and cure a foundry exothermic assembly, typically, a mold exothermic riser sleeve.

When the exothermic riser sleeve is attached at the riser of a mold and the mold is used to cast a high-temperature molten metal such as cast steel, the hollow glass microspheres embedded in the matrix of the sleeve melt and disperse upon being heated to a low temperature of around 800° C. or below by the heat of the molten metal and the heat generated by a combustion (oxidization) reaction initiated by the heat of the molten metal between the aluminum powder and the iron oxide constituting the riser sleeve matrix. As a result, small pores form in the sleeve matrix, so that the matrix is made porous without degrading its refractoriness. Therefore, during the period from the start to the finish of the solidification of the molten metal cast into the mold, the porous riser sleeve manifests excellent heat-retention and maintains the intrinsic high refractoriness of its matrix. The exothermic riser sleeve thus enables high-yield production of excellent quality castings substantially free of defects such as shrinkage and defective casting.

In a preferred embodiment of the present invention, aluminum ash occurring as slag during melting of aluminum ingot (consisting chiefly of alumina but also containing some amount of metallic aluminum and the flux used during melting) is used as a preferable aggregate from the viewpoint of refractoriness, exothermic property, economy and availability. Use of aluminum ash does, however, have a drawback. Specifically, when it is used together with phenol-urethane resin, the most commonly employed binder, it shortens the bench life of the material mixture owing to rapid degradation of the binding property of the urethane resin. This makes volume production impossible.

The present invention also provides a solution to this problem.

A study was conducted to ascertain why the bench life of a material mixture becomes short when phenol-urethane resin is used as the binder of a material mixture containing aluminum ash. The source of the problem was found to be the hygroscopic flux contained in the aluminum ash, more specifically the free water introduced into the aluminum ash by the hygroscopic flux. When phenol-urethane resin is used as the binder of a material mixture containing aluminum ash having a free water content, it rapidly loses its binding power by chemically reacting with the water in the aluminum ash.

In this invention, therefore, the aluminum ash is used as aggregate after first being baked to reduce its water content to substantially zero. Since no water is present in the dried aluminum ash to degrade the binding property of the phenol-urethane resin used as binder, the bench life of the material mixture is prolonged. Volume production is therefore possible. Another advantage is that use of this binder enables elimination of the drying step following foundry exothermic assembly shaping. These effects markedly enhance the industrial utility of the present invention.

The invention will now be explained with reference to specific examples.

EXAMPLE 1

To a mixture formed of, in weight percentage,

| | |
|---|---|
| Aluminum powder | 25% |
| Dehydrated aluminum ash dried at 120–150°0 C. | 30% |
| Hollow glass microspheres of not greater than 1.2 mm-diameter | 36% |
| Potassium nitrate | 6% |
| Cryolite | 3% |

was added 9% of phenol-urethane resin. The result was kneaded, shaped with a core shooter, and cured in a stream of amine gas to obtain an exothermic riser sleeve.

The material mixture for the foundry exothermic assembly added with phenol-urethane resin as binder according to this example was ascertained to have an adequately long bench life to enable volume production of assemblies. The shaped product did not require a drying step.

EXAMPLE 2

To a mixture formed of, in weight percentage,

| | |
|---|---|
| Aluminum powder | 30% |
| Silica | 30% |
| Hollow glass microspheres of not greater than 1.2 mm-diameter | 20% |
| Iron oxide ($Fe_3O_4$) | 12% |
| Potassium nitrate | 8% |

was added 10% of phenol-urethane resin. The result was kneaded, shaped with a core shooter, and cured in a stream of amine gas to obtain an exothermic riser sleeve.

For comparison, an exothermic riser sleeve of the same shape as that of the preceding examples was shaped by the $CO_2$ gas method using ordinary materials for mold exothermic sleeve production (mixture of silicon sand, aluminum, manganese dioxide and cryolite).

The exothermic riser sleeves according to the invention examples and that of the comparative example were then tested by using each to mold steel cast at a temperature of 1550° C. The invention exothermic riser sleeves were found to be markedly superior to that of the comparative example in feeding effect and total freedom from casting defects. They were thus determined to be outstanding in product yield.

When the exothermic riser sleeve according to the present invention was used, the casting surface was totally free of defects. This demonstrates that it exhibited excellent heat-retentivity and refractoriness as an exothermic riser sleeve.

The foundry exothermic assembly according to the present invention is an article produced by shaping and curing a mixture composed of oxidizable metal, oxidizing agent, foundry refractory aggregate, hollow glass microspheres, organic or inorganic setting agent, and, optionally, a pro-oxidant. It has the hollow glass microspheres dispersed and embedded in its matrix. It is attached to an essential portion of a mold requiring a feeding effect.

Take, for example, the exothermic riser sleeve that is typical of the foundry exothermic assembly according to the invention. When the exothermic riser sleeve is attached at the riser of a mold, the hollow glass microspheres dispersed and embedded in the matrix of the riser sleeve melt and disperse upon being heated to a low temperature of, at the highest, around 800° C. by the heat generated by an exothermic reaction of the exothermic material (oxidizable metal, oxidizing agent and optional pro-oxidant) and the heat of the molten metal. Before the hollow glass microspheres react with the surrounding matrix and degrade the refractoriness of the matrix, therefore, small pores are formed in the matrix. Since the matrix therefore becomes porous, it maintains excellent heat-retentivity and refractoriness during and after molten metal solidification. As the riser sleeve therefore produces an excellent feeding effect, it markedly improves casting yield, particularly steel casting yield.

What is claimed is:

1. A foundry exothermic assembly, which is formed by mixing hollow glass microspheres and an inorganic or organic binder with matrix forming constituents including an oxidizable metal, an oxidizing agent, a foundry refractory aggregate and, optionally, a pro-oxidant, and shaping and curing the mixture.

2. A foundry exothermic assembly according to claim 1, wherein the hollow glass microspheres are dispersed and embedded in the assembly matrix.

3. A foundry exothermic assembly according to claim 1 or 2, wherein the hollow glass microspheres are contained in the matrix in an amount of at least 10 wt %.

4. A foundry exothermic assembly according to claim 1 or 2, wherein the diameter of the hollow glass microspheres is 3 mm or less.

5. A foundry exothermic assembly according to claim 1 or 2, wherein the oxidizable metal is powdered and/or granular aluminum.

6. A foundry exothermic assembly according to claim 1 or 2, wherein the oxidizing agent is at least one of iron oxide, manganese dioxide, potassium nitrate and potassium permanganate.

7. A foundry exothermic assembly according to claim 1 or 2, wherein the pro-oxidant is at least one of cryolite ($Na_3AlF_6$), potassium aluminum tetrafluoride and potassium aluminum hexafluoride.

8. A foundry exothermic assembly according to claim 1 or 2, wherein the foundry refractory aggregate is at least one of aluminum slag, silica, olivine, quartz, zircon and magnesium silicate.

9. A foundry exothermic assembly according to claim 8, wherein the aluminum slag is dried in advance to reduce its water content to substantially zero.

10. A foundry exothermic assembly according to claim 1 or 2, wherein the inorganic or organic binder is an inorganic or organic binder used in a sand mold molding method.

11. A foundry exothermic assembly according to claim 1 or 2, wherein the foundry exothermic assembly is an exothermic riser sleeve, an exothermic core, an exothermic neck-down core, an exothermic mold, or an exothermic pad.

12. A foundry exothermic assembly according to claim 3, wherein the amount of the hollow glass microspheres is 20–40 wt %.

13. A foundry exothermic assembly according to claim 4, wherein the diameter of the hollow glass microspheres is 1.2 mm or less.

14. A foundry exothermic assembly according to claim 1 or 2, wherein the inorganic or organic binder is an inorganic or organic binder used in a sand mold molding method selected from the group consisting of a $CO_2$ process, a self-harding process, a fluid sand mixture process, a hot box process and a cold box process.

15. A foundry exothermic assembly according to claim 11, which is an exothermic riser sleeve.

16. A foundry exothermic assembly according to claim 11, which is an exothermic core.

17. A foundry exothermic assembly according to claim 11, which is an exothermic neck-down core.

18. A foundry exothermic assembly according to claim 11, which is an exothermic mold.

19. A foundry exothermic assembly according to claim 11, which is an exothermic pad.

* * * * *